US005080011A

United States Patent [19]

Paxton et al.

[11] Patent Number: 5,080,011

[45] Date of Patent: Jan. 14, 1992

[54] LOW COST TRASH COMPACTOR ASSEMBLY WITH IMPROVED TRASH COMPRESSION AND LOADING CAPABILITY AND FLUID SEALING CHARACTERISTICS AND METHOD OF OPERATION

[76] Inventors: Gerald R. Paxton, 1407 S. Arcadia St., Boise, Id. 83705; Norman W. Seid, 3865 Barstow Ct., Boise, Id. 83709

[21] Appl. No.: 557,512

[22] Filed: Jul. 24, 1990

[51] Int. Cl.[5] ..... B30B 15/06

[52] U.S. Cl. ..... 100/229 A; 100/53; 100/240; 100/266; 100/268; 100/269 R; 100/295; 92/137

[58] Field of Search ..... 100/35, 42, 226, 228, 100/229 A, 238, 240, 258 R, 266, 268, 295, 269 R, 51, 53, 227, 215, 100, 256, 214; 92/137

[56] References Cited

U.S. PATENT DOCUMENTS

| | | | |
|---|---|---|---|
| 3,034,425 | 5/1962 | Huetter | 100/214 |
| 3,514,969 | 6/1970 | Harza | 100/229 A |
| 3,756,143 | 9/1973 | Hennells | 100/100 |
| 3,779,157 | 12/1973 | Ross, Jr. | 100/240 |
| 3,835,769 | 9/1974 | Peterson | 100/266 |
| 3,939,765 | 2/1976 | Jung | 100/100 |
| 4,413,555 | 11/1983 | Swinney | 100/295 |
| 4,565,126 | 1/1986 | McBee | 100/266 |
| 4,873,923 | 10/1989 | Manning | 100/258 R |

*Primary Examiner*—Timothy F. Simone
*Assistant Examiner*—Randall E. Chin
*Attorney, Agent, or Firm*—William J. Bethurum

[57] ABSTRACT

A trash compactor or other materials loading assembly wherein a flexible memory containing ramrod and associated platen may be flexibly driven against a trash load in such a manner as to assume its general contour and provide good trash compacting efficiency. In a preferred embodiment, the ramrod is made of relatively low cost polyvinylchloride (PVC), thereby avoiding the high costs associated with metal components. In addition, the ramrod is flexibly driven by slidable engagement with a PVC piston driver in a seal tight arrangement so as to maintain good liquid tight hydraulic fluid sealing at the side walls of the piston driver. This assembly may be used either in a trash compacting operation or in the high density compacting of new and recyclable materials. The present invention is also directed to a new and improved method of compacting materials in a high density, low cost and efficient mode of operation.

7 Claims, 3 Drawing Sheets

LOW COST TRASH COMPACTOR ASSEMBLY WITH IMPROVED TRASH COMPRESSION AND LOADING CAPABILITY AND FLUID SEALING CHARACTERISTICS AND METHOD OF OPERATION

TECHNICAL FIELD

This invention relates generally to trash compactors and more particularly to portable, hydraulically operated trash compactors of rugged and durable construction and economical to manufacture. The present invention is also directed to a novel method of carrying out the materials compacting operation described hereinbelow which is applicable to trash, recyclable, and new materials alike.

BACKGROUND ART

Generally speaking, hydraulically operated trash compactors in the prior art have used metal shafts or ramrods which are concentrically and slidably mounted for operation in a surrounding metal housing and are spring-loaded therein to receive a hydraulic pumping motion at one end of the housing. The ramrod extends through an opening at the other end of the housing where it is attached to a compacting or platen member operative to compress the trash within an adjacent trash container or the like. This basic hydraulically driven ramrod and housing assembly has been patterned after various types of hydraulically driven piston engines developed over the years in many diverse types of arts such as the field of railway locomotives.

Whereas these types of metal ramrod-driven trash compactors have proven very durable and entirely satisfactory in many respects of operation, the cost of these all-metal mechanical devices has been, for the most part, prohibitively expensive for large scale low cost production methods. More particularly, it has not been possible to substitute lower cost materials such as plastics for the metal components of these trash compactors on a one-for-one basis and thereby obtain a satisfactory and acceptable commercial product which exhibits good uniform trash compacting characteristics in combination with good liquid tight, leak free hydraulic operation. Furthermore, these types of all-metal hydraulically driven designs often require expensive metal guides and metal shafts surrounding the main ramrod member of the compactor in order to provide the necessary support and oscillation guidance for the back and forth motion of a heavy metal ramrod within its surrounding housing.

DISCLOSURE OF INVENTION

The general purpose and principal object of the present invention is to provide a new and improved trash compactor of fundamentally different construction as compared to the above prior art type of all-metal hydraulically driven trash compactor design.

Another object of this invention is to provide a new and improved trash compactor of the type described which is capable of construction using low cost and durable plastic materials such as polyvinylchloride (PVC).

Another object of this invention is to provide a new and improved trash compactor of the type described which additionally exhibits and operates with excellent and uniform trash compression and trash loading capabilities.

Another object of this invention is to provide a new and improved trash compactor of the type described which exhibits excellent liquid tight hydraulic fluid sealing characteristics.

Another object of this invention is to provide a new and improved trash compactor of the type described which is economical and durable in construction and reliable in operation.

Another object of this invention is to provide a new and improved trash compactor of the type described which may be constructed in an elegantly simple manner using readily available materials and components derived therefrom.

Another object of this invention is to provide a new and improved trash compactor of the type described which is operative to enhance the packing density of trash compressed and compacted in a trash container.

Another object of this invention is to provide a new materials compacting method and apparatus of the type described which is sufficiently flexible and adaptable in its fundamental mode of operation to be useful in compacting many different and diverse types of materials at a high packing density within a minimum amount of space.

A novel feature of this invention is the provision of a new and improved method of trash compacting operation which includes the steps of: movably mounting a platen to a flexible, memory containing ramrod, and above an opening in the trash container, and flexibly driving the ramrod from side-to-side with respect to its longitudinal axis so that a compacting surface of the platen rotates in both directions through a horizontal plane normal to the longitudinal axis of the ramrod when the ramrod is in an unflexed and unloaded condition.

The above general purpose, multiple objects, novel features and advantages of this invention are made possible by the provision of, among other things, materials compacting apparatus which includes a rugged, flexible memory retaining ramrod which is spring loaded and slidably mounted within an outer housing. The ramrod is attached to a trash and materials compacting and compressing platen member mounted on the lower end of the ramrod which extends through an opening in one end of the housing. A piston driver member is slidably mounted and fluidically sealed at the other end of the housing and is hydraulically driven by hydraulic fluid lines and hydraulic pressure applied at its top surface. A flat ramrod head (ramhead) member is attached to the upper end of the ramrod and has its upper surface abutting against the lower surface of the piston driver member. The flat ramhead member is operative to slide horizontally back and forth against the lower surface of the piston driver and in an orientation which lies in a plane normal to the vertical longitudinal axis of the ramrod and ramrod housing.

When the ramrod drives the compacting and trash loading platen member at its lower end against a load of trash, the flexure of the ramrod outwardly from its longitudinal axis allows the compacting platen member to conform to uneven trash loads and slanted trash surfaces to provide excellent compression and compacting of these loads into a trash container. Simultaneously, the outward flexure of the ramrod during trash compression and the corresponding bending torque applied to the ramrod drives the ramhead horizontally towards one of the sidewalls of the housing in sliding friction against the lower surface of the piston driver. This sliding motion does not cause the piston driver to move away from its surrounding liquid seals which are located between the sidewalls of the piston driver and the inner walls of the compactor housing.

In addition, the upper surface of the ramhead member is structured and ground with a geometrical configuration that serves to prevent hydraulic lock between the lower surface of the piston driver and the upper surface of the ramhead member. In this manner, the problems of side loading at the piston driver and hydraulic fluid leakage thereat have been totally eliminated. Furthermore, the flexure of the elongated ramrod member allows the trash compacting platen member to rotate about its own central axis and thereby conform nicely to uneven trash loads in a container being compacted. This action in turn serves to transfer loading forces efficiently to a trash load, thereby enhancing the trash packing density in the trash container.

These and other objects, features and attendant advantages of the present invention will become more readily apparent from the following description of the accompanying drawings.

DETAILED DESCRIPTION OF THE PREFERRED EMBODIMENT

Figure 1:
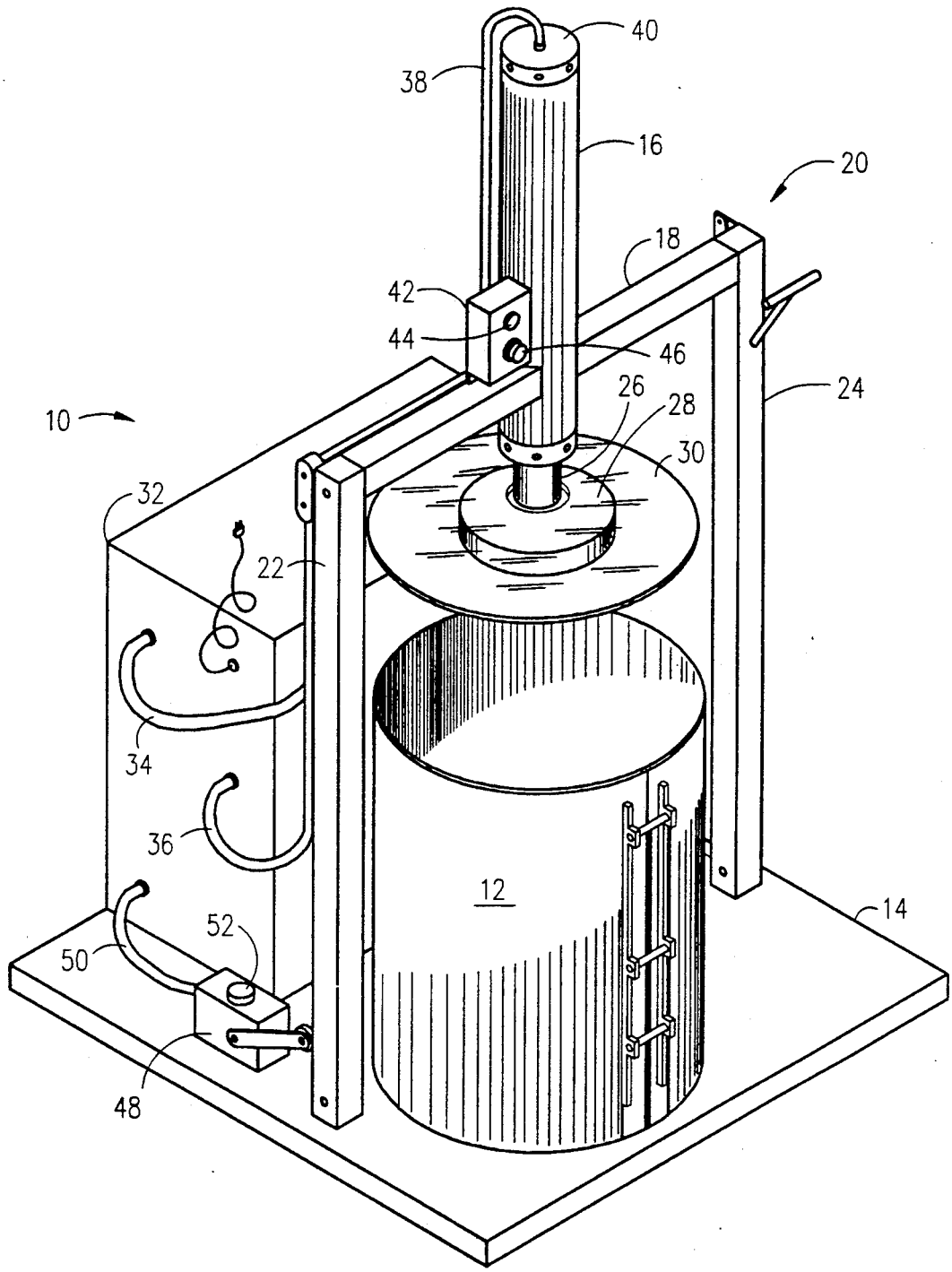
FIG. 1 is an isometric view of the trash compactor according to a preferred embodiment of the invention.

Referring now to FIG. 1, the trash compactor shown therein in isometric view is designated generally as 10 and includes a trash container 12 mounted as shown on a base plate 14 and aligned with a cylindrical ramrod housing 16. The ramrod housing 16 is in turn mounted on a horizontal cross bar 18 of an upstanding frame member designated generally as 20. The frame member 20 further includes vertical support members 22 and 24 secured at their upper ends to the cross bar member 18 and secured at their lower ends to the base plate 14. The housing 16 surrounds a piston driven ramrod 26 shown in its retracted position, and the ramrod 26 is joined at its lower end to a compactor head or platen member 28 which is covered by a safety shield 30.

A hydraulic pump and associated motor housing or chassis 32 is mounted as shown on the back side of the base plate member 14 and is connected to a hydraulic fluid line 34 which extend upwardly and are joined to a single hydraulic fluid line 38 which leads into the upper cap or cylinder 40 for the ramrod housing 16.

A power switch 42 is mounted as shown on the horizontal cross bar 18 and includes a control panel cycle button 44 and an emergency off button 46. This emergency off switch 42 may be controlled by the operation of the push button 46 to remove all hydraulic pressure from the ramrod housing 16 in case of an emergency or other situations arising wherein it becomes desirable to immediately stop the compacting operation of the apparatus. In addition, a safety switch 48 is mounted adjacent to the facing wall of the housing or chassis 22 and is connected through an electrical conduit 50 to the electric motor (not shown) within the housing 32.

Figure 2A:
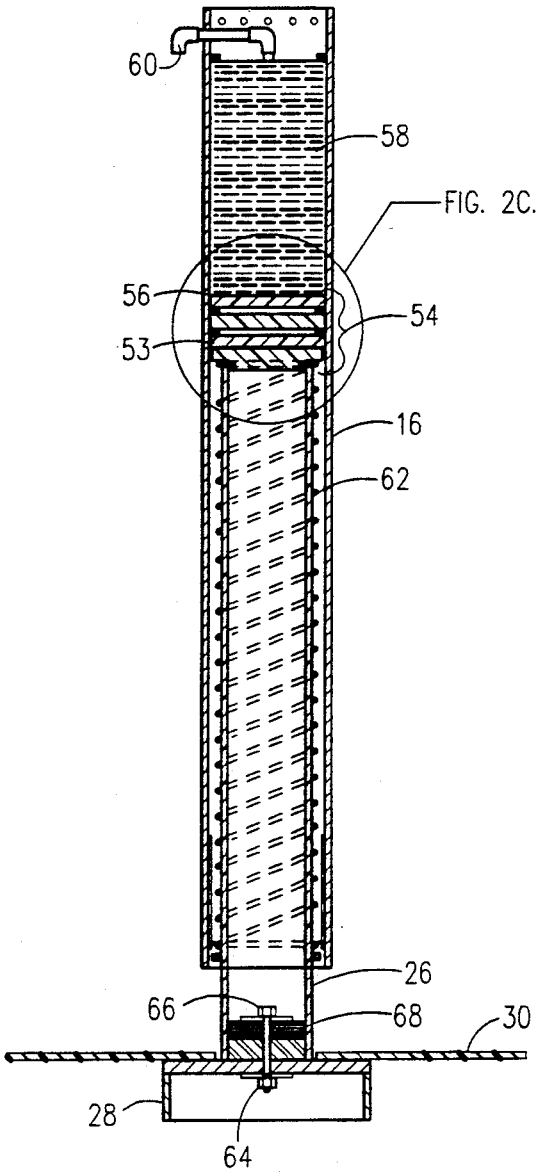
FIG. 2A is a cross sectional view taken along lines 2—2 of FIG. 1, showing the ramrod in its retracted position.
Figure 2B:
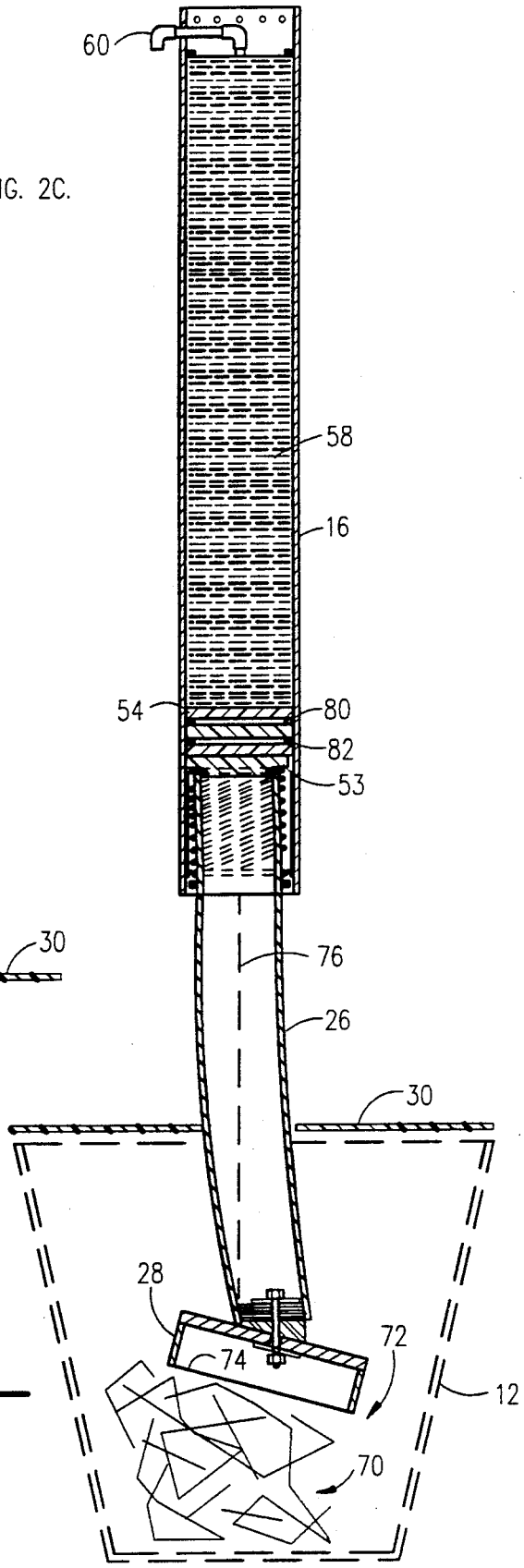
FIG. 2B is identical to FIG. 2A, except that this figure shows the ramrod in its extended position and extending into a trash container.

Referring now to FIG. 2A, the ramrod housing 16 and ramrod 26 are concentrically positioned, with the ramrod 26 in a retracted position so that the ramrod head or "ramhead" 53 and its associated piston driver 54 are positioned adjacent to a fluid level point 56 within the ramrod housing 16. In this position, there is no hydraulic pressure applied to the hydraulic fluid 58 by way of the incoming hydraulic line 60. In FIG. 2A, the coil spring 62 is in its extended decompressed position as shown around the outer walls of the hollow ramrod 26, and the ramrod 26 is joined to the compactor head or platen 28 by means of a nut 64 and a bolt 66 between which are inserted a plurality of slidable concentric washers 68. The washers 68 are preferably cut from preferably a durable and soft or low-deformation type rubber so that they are able to flex from side to side as shown in FIG. 2B below. The safety shield 30 is concentrically mounted with respect to the platen 28 and the ramrod 26 extends through a central opening therein.

When hydraulic pressure and fluid are applied via line 60 to the ramrod housing as indicated in FIG. 2B, the ramrod 26 is forced in a downwardly direction so as to drive the platen or compactor head 28 into direct physical contact with a load of trash 70 within the container 12. For the position and incline of the trash load 70 shown in FIG. 2B, the interlocking mounting arrangement including the washers 68 and the nut 64 and bolt 66 allows the washers 68 to slide horizontally with respect to each other as shown and thereby allow the compactor head or platen 28 to rotate clockwise in the direction of the arrow 72 shown. In this manner the bottom surface 74 of the platen 28 is allowed to assume the general surface incline or contour of the trash load 70. At the same time, the force of the ramrod 26 against the platen 28 is thrust directly toward the center of mass or gravity of the trash load 70, thereby forcing the trash load 70 with maximum thrust efficiency toward the bottom surface of the container 12. This action prevents the force on the trash load 70 from pushing the trash load 70 with undue force into the vertical sidewalls of the container 12 and thereby produce a bulging of these sidewalls.

The additional novel feature of the present invention which allows the compactor head or platen 28 to assume the above contour of the trash load 70 is that the polyvinylchloride (PVC) memory-containing ramrod 26 flexes from side to side with respect to the longitudinal axis 76 of the ramrod 26 and ramrod housing 16. This flexing of the ramrod 26 in turn produces a bending torque on the ramrod 26 and thereby causes a right to left shifting or sliding action in FIG. 2B of the ramrod head 53 against the lower surface 78 of the piston driver 54. However, since the ramhead 53 and the piston driver 54 are in slidable engagement, this sliding friction action produced between these two members 53 and 54 does not cause the liquid seals 80 and 82 to be pulled away from the interior wall of the ramrod housing 16. Thus, this sliding action or coupling ensures that there is no fluid leakage past the seals 80 and 82 along the interior sidewalls of the ramrod housing 16 adjacent to the piston driver 52. Thus, the piston driver 54 is multi-functional in that it simultaneously provides the driving force for the ramrod 26 and fluidic sealing within the ramrod housing 16.

Figure 2C:
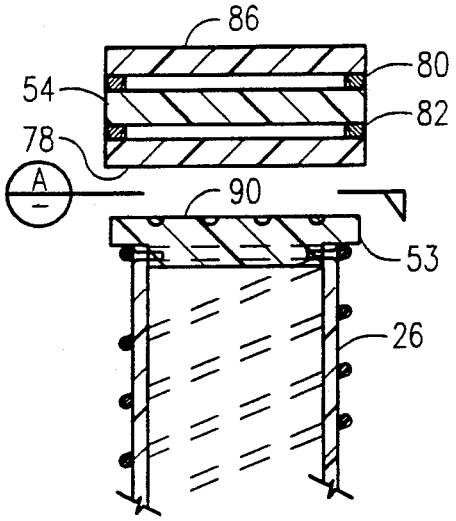
FIG. 2C is an enlarged or exploded view of the piston driver and ramrod head (section A) of FIG. 2A.
Figure 2D:
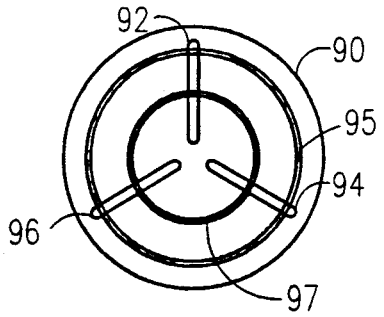
FIG. 2D is a plan view of the ramrod head of FIG. C and shows the elongated recessed surface grooves therein.

Referring now to FIGS. 2C and 2D, the piston driver 54 is shown therein in enlarged cross section and includes a driver top plate or disk 86 in contact with the hydraulic fluid 58 (FIG. 2B) and the cylindrical seals 80 and 82 which are positioned as shown around the outer periphery of the driver 54. As previously indicated, the lower surface 78 of the piston disk 54 is in slidable engagement with the top surface 90 of the ramhead 53. The top surface 90 of the ramhead 53 is provided with three symmetrically spaced elongated grooves or slots 92, 94, and 96 therein spaced at the 120° positions shown and is further provided with a pair of grooved rings 93 and 95. .These elongated grooves 92, 94, and 96 and grooved rings 93 and 95 allow air to accumulate therein and prevent hydraulic lock up under hydraulic pressure and prevent the hydraulic locking of the upper surface 90 of the ramhead 53 against the lower surface 78 of the piston disk 54.

The following is an example of typical component values, sizes, and materials used in a trash compactor of the type described above which has been successfully built, tested, operated, and fully reduced to practice. However, it should be understood that the following values are given by way of an example only in an effort to assist those skilled in the art to practice the invention and are in no way limiting on the scope of the claims herein.

EXAMPLE

The ramrod housing 16 is constructed of aluminum, and the piston driver 54, ramrod 26, and ramhead 53 are all constructed of polyvinylchloride (PVC). The platen 28 will be preferably constructed of steel. The seals 80 and 82 have been fabricated of neoprene, and the mainframe members 18, 22 and 24 have been constructed using a three inch by three inch square tubing. The trash container 12 has consisted of a thirty-eight gallon, molded high impact polyethylene plastic material with stainless steel door hinges and accessories.

The hydraulic reservoir within the housing or chassis 32 has been constructed of an eight gallon molded high impact polyethylene plastic material, and the hydraulic pump within the housing has been a 150 pounds per square inch adjustablepressure, relief type pump. The steel base 14 has been configured thirty-one inches wide and thirty-two inches deep, and the electric motor used with the hydraulic pump within the housing 32 has been a one-half horsepower motor operative at 1725 RPM, and at 8 amps, with a thermally protected automatic reset feature. The hydraulic pressure hoses shown in FIG. 1 have been constructed of a nylon weave, high pressure transparent polyvinylchloride.

Various modifications may be made in and to the above described preferred embodiment without departing from the spirit and scope of this invention. For example, there are many design modifications and equivalents which may be made to the above described piston driver and ramrod component assembly, as well as to the particular interlock mounting of the compactor head or platen on the end of the ramrod, while still obtaining the advantages and benefits of the uniform trash loading, flexure and torque motion described above. These advantages not only gain the benefit of uniform trash loading and compacting without resorting to heavy metals, but there is the advantage that there is always provided good liquid tight sealing between the hydraulic fluid 58 within the upper portion of the ramrod housing 16 and the ramrod 26 and ramhead 53 as previously described.

In addition, the novel trash compactor described herein may be designed, constructed and scaled accordingly to operate in both commercial and consumer environments and may be modified to be operative with additionally joined trash containers. For example, the trash compactor apparatus shown in FIG. 1 may be permanently mounted in a fixed location and immediately above another removable trash container (not shown) which is concentrically aligned through an opening (not shown) in the base plate 14. In this type of application, the trash container 12 could be fixedly mounted on the base plate 14 so that the entire apparatus of FIG. 1 can be fixed in place underneath a counter top in the home or in a manufacturing plant or the like.

It is also within the scope of this invention and the claims appended hereto to employ the present invention and its associated method of operation in applications other than the compacting of "trash" per se. For example, it is entirely possible and even highly likely that the above described apparatus and method will prove highly useful and advantageous in compacting other-than-trash materials such as recyclable materials which may not be classified as "trash" or even in new materials such as fresh newspapers, magazines or the like which have a definite need of being packed into the smallest possible space in the least amount of time with the highest degree of efficiency using a low cost apparatus such as is described herein. Thus, the present invention will be extremely useful in applications which require the rapid, efficient and low cost tamping of certain materials destined for future use and therefore not classifiable as "trash".

Accordingly, these and other design equivalents and modifications which may be made by those skilled in the art to tailor the compactor operation described herein to a particular application are clearly within the scope of the following appended claims.

We claim:

1. An apparatus for compacting materials within containers while simultaneously providing good absorption of slideloading forces applied thereto, said apparatus including a flexible memory-retaining ramrod comprising a semi-rigid tube oriented for loading along its central axis and being responsive to said loading to flex away from said central axis in response to side loading forces applied to said tube in a direction normal to said central axis, said ramrod being operatively and hydraulically driven within a housing and having a rotatable platen secured at one end thereof, whereby the flexure of said ramrod within said housing operates to enhance both the packing efficiency of said apparatus and the packing density of materials being compacted.

2. The apparatus defined in claim 1 wherein said ramrod is hydraulically vertically driven by a piston driver within said housing while being in horizontal slidable engagement with an abutting surface thereof, whereby said piston driver is enabled to remain in seal tight engagement with the interior walls of said housing and prevent hydraulic fluid from passing by said piston driver.

3. The apparatus defined in claim 2 wherein either said ramrod or said piston driver has a plurality of grooves therein at their plane of abutment to prevent hydraulic lockup as said piston driver and said ramrod move in slidable engagement with each other.

4. The apparatus defined in claim 3 wherein said ramrod and said piston driver are made of polyvinylchloride (PVC).

5. The apparatus defined in claim 2 wherein said ramrod and said piston driver are made of polyvinylchloride (PVC).

6. A low cost materials compactor assembly including, in combination: a flexible, memory-retaining ramrod which is spring loaded and slidably mounted within an outer housing; a trash compacting and compression platen member mounted on the lower end of said ramrod which extends through an opening in one end of said housing; a piston driver slidably mounted and fluidically sealed at the other end of said housing and hydraulically driven thereat by hydraulic pressure received at its top surface from one or more hydraulic lines; a flat ramrod head member attached to an upper end of said ramrod and abutting against a lower surface of said piston driver; said flat ramrod head member being operative to slide horizontally back and forth against said piston driver, whereby the flexure of said ramrod outwardly from its longitudinal axis when said ramrod drives said compacting platen member at its lower end against a trash load allows said compacting member to conform to uneven trash loads and trash surfaces to provide excellent compression for said loads in a trash container or the like; thereby minimizing side loading on said piston driver member and preventing any hydraulic fluid from leaking past said seals.

7. The apparatus defined in claim 6 wherein said piston driver member, ramrod head and ramrod are all fabricated of polyvinylchloride (PVC), and said trash compression platen member is made of metal.

* * * * *